United States Patent [19]

Diehl Pojedinec

[11] Patent Number: 4,927,036

[45] Date of Patent: May 22, 1990

[54] CONTAINER WITH TAMPER INDICATOR USING PIPED LIGHT

[76] Inventor: Edward P. Diehl Pojedinec, 112 S. Valley Rd., Lincoln Park, N.J. 07035

[21] Appl. No.: 312,433

[22] Filed: Feb. 17, 1989

Related U.S. Application Data

[63] Continuation of Ser. No. 9,720, Feb. 2, 1987, abandoned.

[51] Int. Cl.[5] ..... B65D 55/02

[52] U.S. Cl. ..... 215/203; 215/230; 215/250; 220/265; 350/96.2

[58] Field of Search ..... 116/DIG. 5, DIG. 26; 215/230, 203, 250; 350/96.10, 96.20, 96.26; 200/313, 315; 220/265, 266

[56] References Cited

U.S. PATENT DOCUMENTS

| | | | |
|---|---|---|---|
| 3,780,248 | 12/1973 | Martin | 200/313 X |
| 3,819,928 | 6/1974 | Kuroyama et al. | 200/313 |
| 4,071,726 | 1/1978 | Werda | 200/313 X |
| 4,095,872 | 6/1978 | Stieff et al. | 350/96.24 |
| 4,104,981 | 8/1978 | Ono et al. | 200/313 X |
| 4,106,849 | 8/1978 | Stieff | 350/96.24 |
| 4,130,341 | 12/1978 | Stieff | 350/96.20 |
| 4,161,348 | 7/1979 | Ulrich | 350/96.20 |
| 4,407,562 | 10/1983 | Young | 350/96.20 |
| 4,432,601 | 2/1984 | Mannschke | 350/96.20 |
| 4,447,123 | 5/1984 | Page et al. | 350/96.24 |
| 4,489,841 | 12/1984 | Thompson | 215/230 |
| 4,609,114 | 9/1986 | Roy | 215/220 |
| 4,657,339 | 4/1987 | Fick | 350/96.20 |
| 4,662,710 | 5/1987 | Berge | 350/96.10 |
| 4,682,844 | 7/1987 | Mori | 350/96.10 |

*Primary Examiner*—Stephen Marcus
*Assistant Examiner*—Nova Stucker
*Attorney, Agent, or Firm*—Bernard J. Lacomis

[57] ABSTRACT

A tamper evident device is disclosed herein comprising in its most basic form a light guide with finished ends; one of which serves to collect light, the other to emit said light to serve as a light emitting indicator. The invention is attached to closures and containers so that upon opening, the light path is interrupted causing the indicator to go dark, thus signalling a tampered condition.

13 Claims, 8 Drawing Sheets

FIG. 17
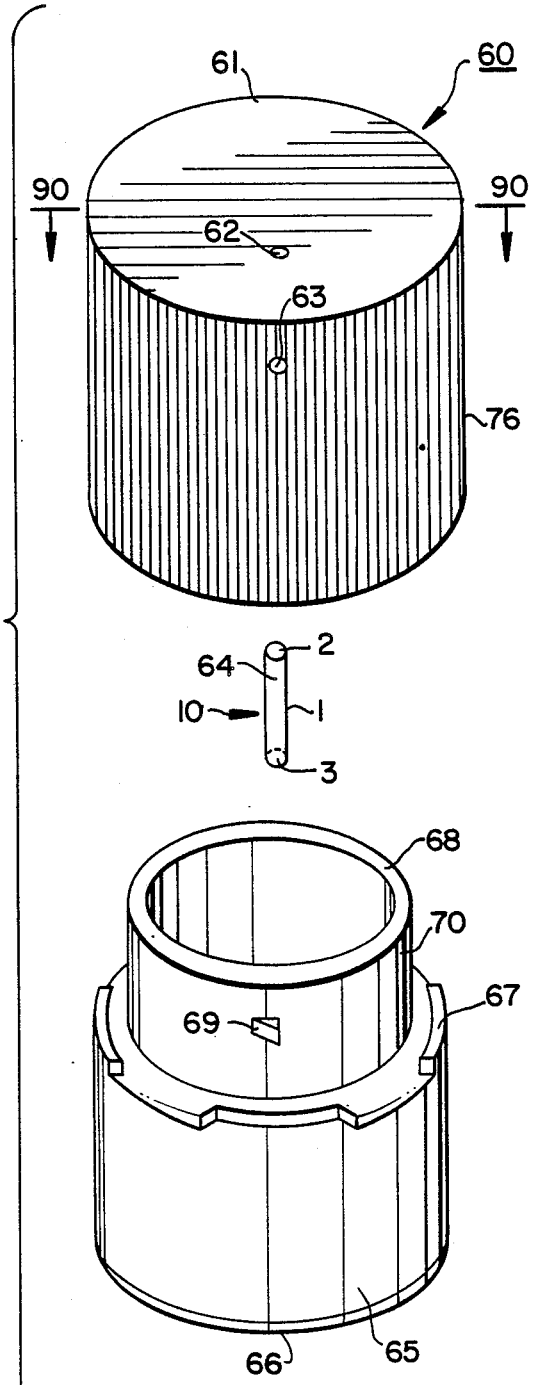
FIG. 17
FIG. 18
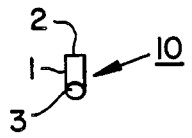
FIG. 19
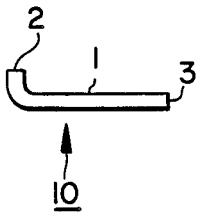

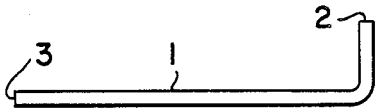
FIG. 28
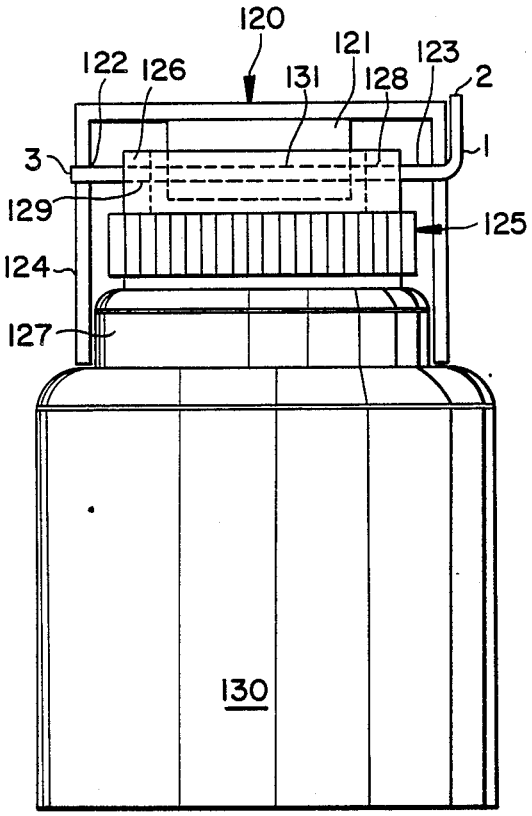
FIG. 29
FIG. 30
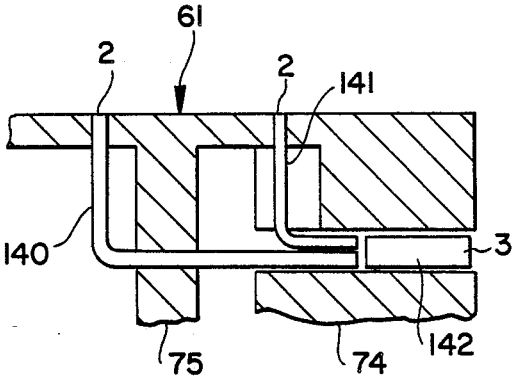
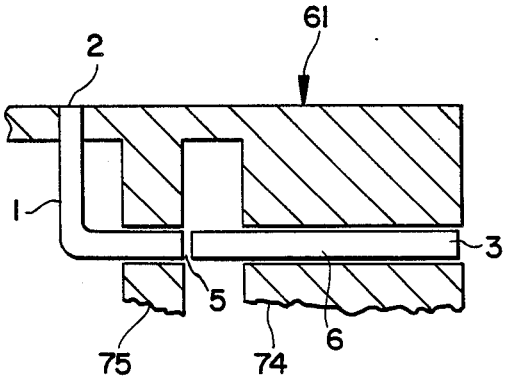
FIG. 31
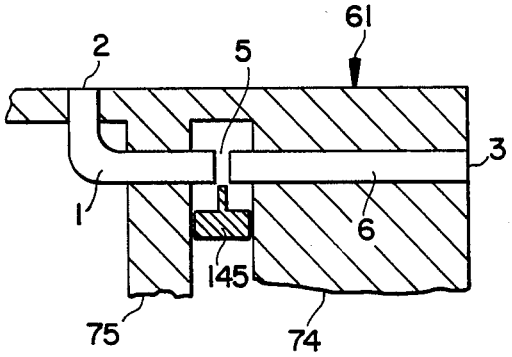
FIG. 32
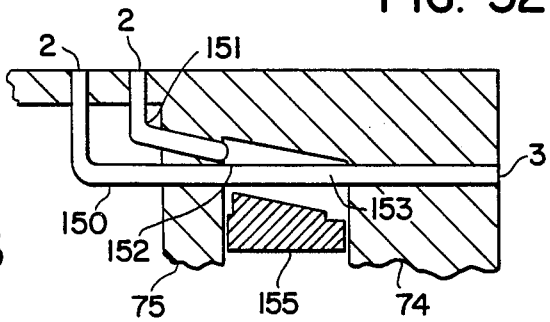
FIG. 33

CONTAINER WITH TAMPER INDICATOR USING PIPED LIGHT

This application is a continuation of application Ser. No. 009,720, filed February 2, 1987, now abandoned.

BACKGROUND OF THE INVENTION

The invention generally relates to closures and containers that provide an indicating means for tampering. The invention more specifically relates to an improved tamper indicating means which was a light guide. It can be applied to any type of container.

For more than sixty years a wide variety of tamper indicating closures have been invented. Generally, these closures all strive to give a visual indication of opening, most of these closures have been for medicines and drugs. These past designs have generally been narrow in their application; for example, a device for a bottle cap would not be suitable for a box. Although many of these past designs have been ingenious in their own right, they all suffer several important limitations. The first limitation is that the indication that most of these designs provide is not obvious unless one has a knowledge of the indicator's untampered appearance. Most people will not take the time, especially in a store, to read instructions; and many do not have eyesight good enough to read the fine print on labels and to examine packaging for signs of tampering. Since there are so many different types of indicators, this makes it even more difficult for the consumer. A second limitation is that a large number of the tamper indicators can be replaced with a little glue or epoxy. Even if the tamperer should substitute, say, a different piece of foil, or seal for the original, the customer may not recognize this. Many bottles have wound up being studied in laboratories in attempts to determine if they had been opened.

A final problem is that many of the tamper indicating means are not visible until a buyer brings the product home and opens it. This can cost the manufacturer a large sum of money when the possibility of other containers being contaminated triggers a recall and the necessity of opening thousands of containers.

The object of the present invention is to provide a tamper evident means that is so noticeable and obvious that people with poor vision that prevents them from reading labels can differentiate between tampered and untampered containers at the store, before purchase. The indication should be bright enough to be seen at a glance, and, at a distance.

Another object is to provide a tamper evident device that cannot be repaired after opening, and that cannot be painted over or faked with another strip or label.

A further object is to provide a tamper evident device that can be adapted to any type of container design without large changes in manufacturing lines, and cost effective designs. The containers can be for foods, drugs, valuables, or anything that requires security.

SUMMARY OF THE INVENTION

The invention comprises a light guide, a means for ambient light to enter the guide, a light exit or indicator, and, a section for interruption. In its most basic form it is a length of optical material such as glass, plastic optically clear or colored, or a length of a fiber optic light guide with flat finished ends and of a size and strength that will break under the force available in the intended design. The invention is attached to a closure or container such that ambient light enters the guide and exits at the indicator end. Upon opening the closure, the light path is interrupted. This causes the light leaving the exit or indicator to change. The interruption can be a break, a displacement or a misalignment, a bending past the maximum angle of transmission, a blocking of the light path, or a destruction of the outer surface of the guide.

The most basic mode of operation is one in which a safe container displays a light emitting indicator, while for a tampered container the indicator goes dark.

DESCRIPTION OF THE INVENTION

To enhance the operation of the invention the light collecting end should be facing generally up or up and somewhat forward, toward the front of the package since in stores the lighting is from overhead and a forward and upward direction works well on shelves. This positioning is not critical since the angle of acceptance of some common light guides can be more than 55°. Under average lighting, the invention will appear as a glowing light emitting dot. One of the best choices for light guides are optical fibers of glass or plastic. These fibers come in a wide range of sizes and bend radius capabilities. A notch, scratch, or necking down at the section of interruption will further enhance breaking. Another form is the fiber optic bundle that consists of a large number of very fine fibers. The closure should be designed to produce a tear, or jagged break and as many breaks as possible in each light path.

A section under tension or a length along which there is no bonding or support generally produce the most uneven breaks. There are an endless number of versions one can employ to utilize this invention, and even though they can have different mechanical configuration, the invention works the same in all cases. A simple way to use the invention with a cap and bottle is to permanently bond the invention between both cap and bottle so that the guide must be broken to remove the cap. The invention can be positioned between both bottle and cap in numerous ways, but generally a configuration is desired that will produce breaks in difficult to reach areas, for example, under the cap skirt. The invention can be molded into the cap and/or bottle as an insert, mechanically fastened, or bonded by glue, epoxy, or other suitable means.

The invention may be produced as a light guide in a strip of plastic or similar material, in single, or multiple light guides, and, wrapped and bonded around a container so that one end points generally up and the other end generally horizontal. In this form with a suitable adhesive, the invention can be used as a tape. When a piece is cut off, the end must be finished flat and smooth. This can be accomplished by a number of methods, all of which are well known to the fiberoptics industry. Plastic fibers can be cut using a hot knife, leaving a finished surface, or, for both glass and plastic, the ends can be held in jigs and lapped by starting with a coarse abrasive paper and progressively lapping with finer paper.

Closures of the self contained type that are tamper evident can be made using this invention. Mechanisms such as those in U.S. Pat. Nos. 4,603,785 and 4,588,098 utilize relative movement between the outer cap and an inner cap or disc and, can be combined with this invention. The invention can be mounted in the outer cap so that the light collecting end and the indicating end are disposed in generally vertical and horizontal positions respectively. The light guide then can be acted on by interruption means driven by the relative movement of the inner cap or disc upon opening.

A new configuration for a combination child proof and tamper evident closures can be made by combining the invention with a double cap closure that has a ratchet system, a complimentary drive system, and a vertical interruption mechanism. The ratchet system stays engaged at all times and is used for initially putting the cap on the container. The vertical interruption mechanism breaks the light path when the outer cap is pushed down. In the down position the complimentary drive can be engaged to open the closure. This is the child-proof feature.

Another version for machine insertion works in a similar manner. The closure has a starting position of the outer cap in a raised position and the indicator emitting light. In this position the outer cap cannot be pushed down. The cap is then threaded on the container and tightened. Now, the cap is backed off and pushed down, interrupting the light path and causing the indicator to go dark. With the outer cap in the down position, the complimentary lugs can be engaged, providing the child proof feature. Another good design to utilize this invention has the light guide pass through both the cap and the bottle neck, bonded to both with a suitable adhesive. The light guide will be broken at least twice if passed through both sides, once if passed through from the cap top to the side. A similar arrangement can be made by placing an overcap over the top of a capped container with axially aligned transverse holes through both caps. The invention can be inserted through the holes with a thin layer of adhesive; upon removing the overcap, the guide will be broken in at least two points, thus interrupting the light path and causing the tamper indicator to go dark.

Colors can be added to the indicator in several different ways. Most light guides in short lengths transmit all colors. Thus colored filters can be placed in the light path to produce an indicator of a given color. Another method is to use tinted glass on plastic, or to clad with tinted cladding. The use of a proprietary color can add further security. Another use of color is to have a change of color to indicate tampering.

In place of a blocking element, a filter of a different color can be inserted in the light path to change the color, or a clear light guide with a light exit or indicator can be axially aligned to a light guide with light collecting means of one color for a safe indication, and displaced by opening the container to axially align with another guide of another color to indicate tampering. Another method to change color is color mixing. At least two light guides must feed at least two different colors of light to an area in which the colors can be superimposed on one another to form a resultant color as an indicator. When one of the light guides is interrupted, the resultant color changes.

The above methods can be implemented by a large number of mechanical configurations; several additional variations are: a flip open cap with a light guide placed in a position to interrupt as the cap flips up, a lever design in which the lifting of the lever ruptures a light guide, and, a bottle mouth seal containing said invention disposed across the seal such that the light guide must be broken to open the seal. Although the best positions for the light collecting and emitting surfaces are up and outward respectively, the invention will work in most positions and, a large number of versions can be designed around these other positions.

BRIEF DESCRIPTION OF THE DRAWINGS

FIG. 17 is an exploded isometric view of a childproof and tamper evident cap utilizing the invention as a tamper evident element.

FIG. 18 is a front view of the invention.

FIG. 19 is a left side view of FIG. 18.

FIG. 28 is the invention as used in FIG. 27.

FIG. 29 is a front view of an overcap design with the overcap shown in cross section.

FIG. 30 is an enlarged and modified view of the upper right hand corner of FIG. 22 showing a color mixing version of the tamper evident device.

FIG. 31 is an enlarged and modified view of the upper right hand corner of FIG. 22 showing the displacement mode of operation.

FIG. 32 is an enlarged and modified view of the upper right hand corner of FIG. 22 showing the blocking mode of operation.

FIG. 33 is an enlarged and modified view of the upper right hand corner of FIG. 22 showing a color switching mode of operation.

In the basic form of the novel invention the end surfaces are similar and thus either end can serve both functions. In more complex versions, the light collecting end can have a lens to provide a greater collection of light, while the light exit can be shaped to represent a symbol.

Figure 1:
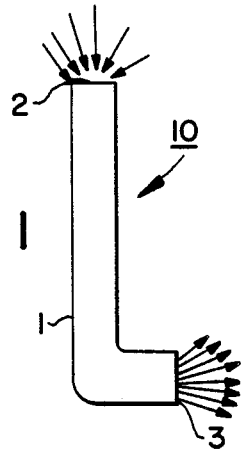
FIG. 1 shows a tamper evident light path device.

The invention provides a new improved approach to the design of tamper evident containers that can be applied broadly, to most container types. FIG. 1 shows a device 10 comprising a light guide 1 of an optically transparent material, a means for allowing light to enter 2, which, in this case, is simply a flat end with a smooth surface. An indicator 3 is shown, which, in this case, is nothing more than another flat smooth surface, and, a section for interruption, which in this instance is the body of the guide. The body could be a necked down or weakened section. Light enters the device 10 at 2, travels through the guide 1 and exits at the exit 3, which appears as a glowing spot.

Figure 2:
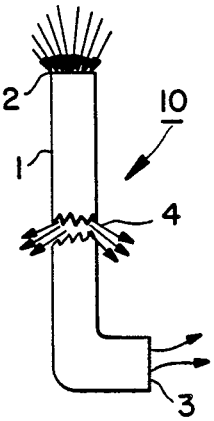
FIG. 2 shows the light path device of FIG. 1 interrupted by a break.

FIG. 2 shows the device 10 after an interruption in the form of a break 4 in the guide. The break 4 results in that the light coming down the guide 1 impinges on the jagged surface of the break 4 and scatters. Most of the light is lost and the exit 3 goes to a semi-dark state, indicating tampering. To make the exit go completely dark, the break should leave the broken surfaces misaligned as well.

Figure 3:
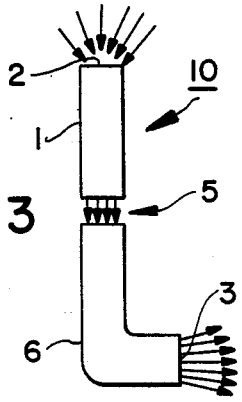
FIG. 3 shows a two piece light path device.

FIG. 3 shows the device 10 in a two piece form. The light enters the surface 2, travels through the upper guide 1, through the section for interruption which in this case is a gap 5, through the lower guide 6, and out the exit 3, thus indicating an untampered state. There will be some light loss due to the gap 5, however, this can be kept to a minimum by preparing the gap surfaces to be flat, smooth, parallel, and close.

Figure 4:
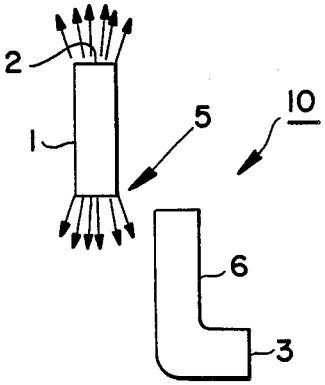
FIG. 4 shows the two piece device of FIG. 3 interrupted by a relative displacement between the two halves.

FIG. 4 shows the device 10 of FIG. 3 after the relative displacement of the upper guide 1 with respect to the lower guide 6 caused by opening a container. The light travels through the upper guide 1 but cannot enter the lower guide 6 because of the axial misalignment. Thus, the exit 3 goes dark indicating tampering.

Figure 5:
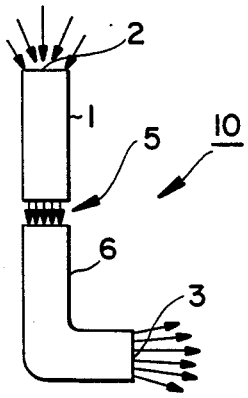
FIG. 5 shows a two piece light path device with a gap.
Figure 6:
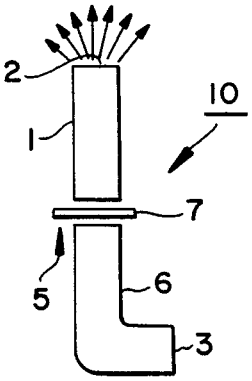
FIG. 6 shows the light path device of FIG. 5 with an interruption of the light by blocking.

FIG. 5 is another two piece configuration of the device 10. Light enters the device 10 at the surface 2, travels through the upper guide 1, through the section for interruption which in this case is a gap sufficiently wide to allow the introduction of a blocking element, travels through the lower guide 6 and exits through 3. FIG. 6 is the invention of FIG. 5 after the blocking element 7 has inserted in the gap 5, and thus, the exit 3 goes dark, indicating a tampered state.

Figure 7:
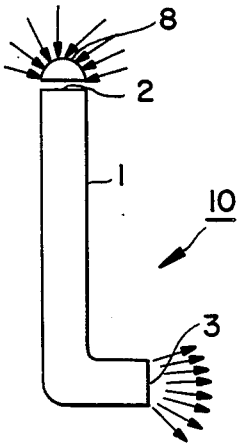
FIG. 7 shows a light path device with a lens for collecting more light.

FIG. 7 is the device 10 wherein the means by which light enters the guide 1 comprises a surface 2 and a lens 8. The lens 8 enables more light to enter the guide 1 and exit from the indicator surface 3, thus providing a brighter indicator 3.

Figure 8:
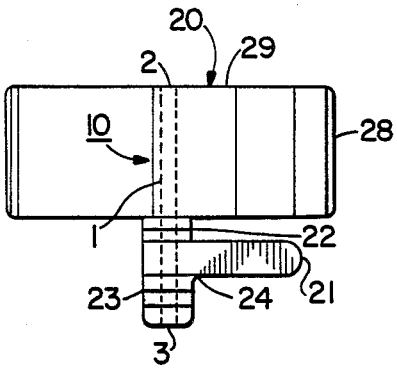
FIG. 8 shows a front view of a bottle cap with a tab containing the invention.

FIG. 8 is a front view of cap 20 with a tab 24 depending from the skirt 28. The device 10 is disposed lengthwise and vertically through both the cap skirt 28 and the tab 24. The light collecting means 2 is exposed to light through the cap top 29. The indicator or light exit 3 is at the bottom of the tab 24; however, when mounted, the tab will be bent and the indicator and will point horizontally. The tab 24 has two weakened tear points 22 23 in the section for interruption and a tab handle 21 which is used to tear off the tab 24 and break the optical guide 1.

Figure 9:
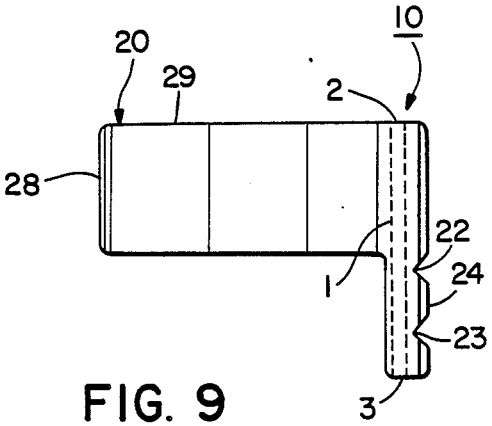
FIG. 9 shows a left side view of FIG. 8.

FIG. 9 is a left side view of the cap 20 of FIG. 8. The light guide 1 can be seen positioned toward the back of the tab 24. The tear points 22 and 23 are shown as "v" groves. The "v" grove 23 also serves as a bend point.

Figure 10:
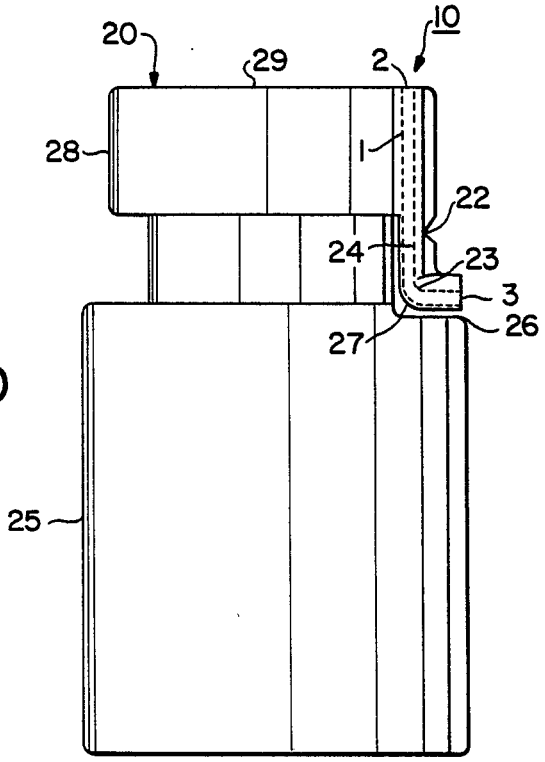
FIG. 10 is a left side view as in FIG. 9 mounted on a bottle.

FIG. 10 is a left side view of the cap in FIG. 8 mounted on a bottle 25. The tap 24 is bent at the grove 23 and is bonded with a suitable permanent adhesive to the bottle shoulder 26. The point 27 of the light guide 1 is bent and under stress, this is the section for interruption, a break at this point will cause the portion of the guide 1 bonded to the shoulder 26 to flex back such that the guide 1 axis is perpendicular to the neck of the bottle 25. This will cause a misalignment should a person try to rebond the tab back in place. The bottle neck can be groved at the point of bonding with the tab, making a more secure bond that is more difficult to circumvent.

Figure 11:
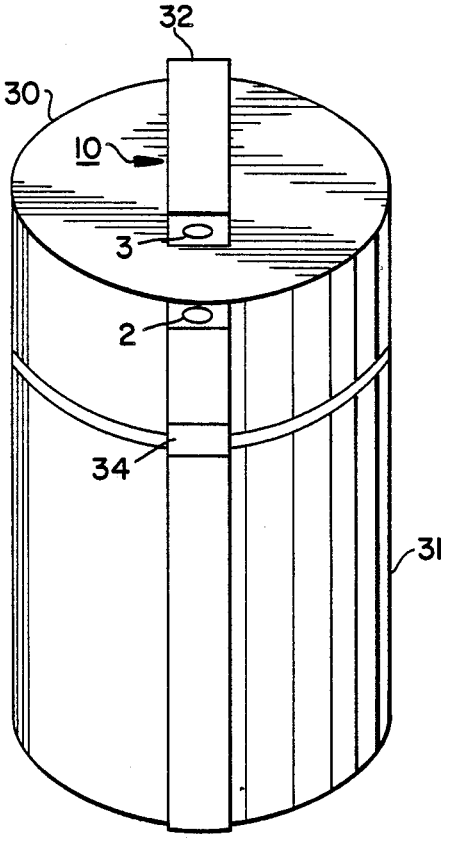
FIG. 11 is an isometric view of a container sealed by the invention in the form of a rectangular cross section strip with the invention imbedded in the strip.

FIG. 11 is a front view of a container 31 wrapped and bonded by the device 10 in the form of a light guide 1 in a flexible strip 32; such a strip can be produced by extrusion. Bonding is applied between the strip 32 and the container 31 and the cap 30 by a permanent epoxy, glue, heat bonding, or other suitable means. Two notches 33 and 34 at the points of interruption serve as break points. The end with surface 2 is bonded to the cap 30 in a vertical direction to collect overhead light, the surface 3 is positioned to be visible along a horizontal plane.

Figure 12:
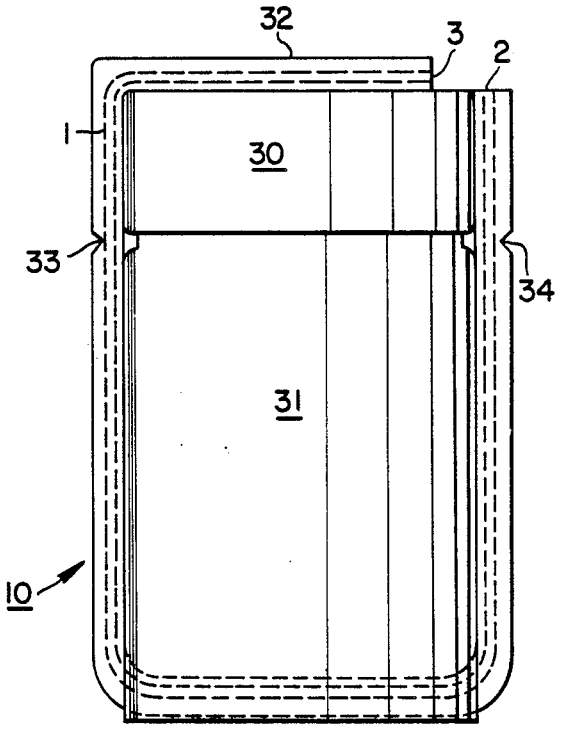
FIG. 12 is a left side view of FIG. 11.

FIG. 12 is a left side view of FIG. 11. The notches 33 and 34 are positioned to receive the shearing force generated by applying a twisting effort to the cap 30. Light enters the invention through the surface 2, travels around the container 31 and exits through the surface 3, giving the appearance of a glowing dot. To open the container, the light path must be broken twice, causing the dot 3 to go dark, indicating a tampered condition.

Figure 13:
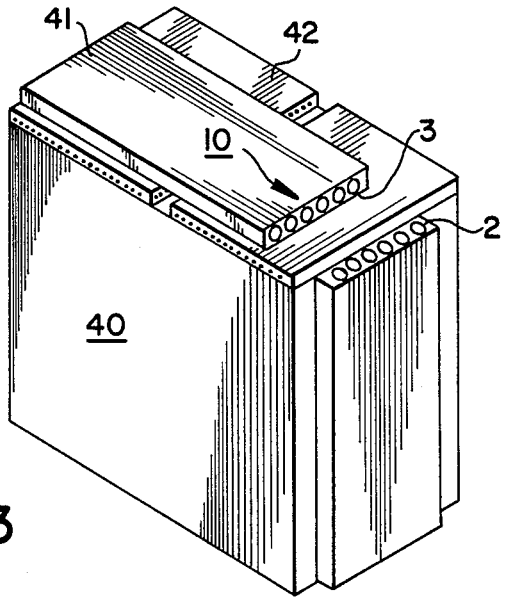
FIG. 13 is an isometric view of a box sealed with the invention in the form of a fiberoptic tape.

FIG. 13 shows the device 10 in the form of a flat flexible strip 41 with multiple light guides, applied to a box 40. As in FIG. 11 and FIG. 12, the strip is bonded to the box 40 with a suitable adhesive. The operation is essentially the same as the bottle in FIG. 11 and FIG. 12 only now a row of glowing dots consisting of light exits 3 appear to signify an untampered container. To open the box, the strip is cut through causing the light exits to go dark.

Figure 14:
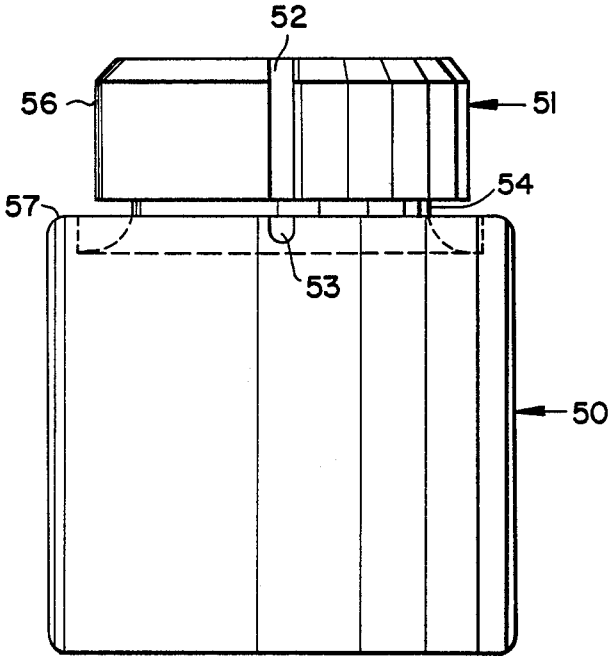
FIG. 14 is a front view of a tamper evident bottle cap combination with a grove in the skirt of the cap and the bottle shoulder ready to accept the invention.
Figure 23:
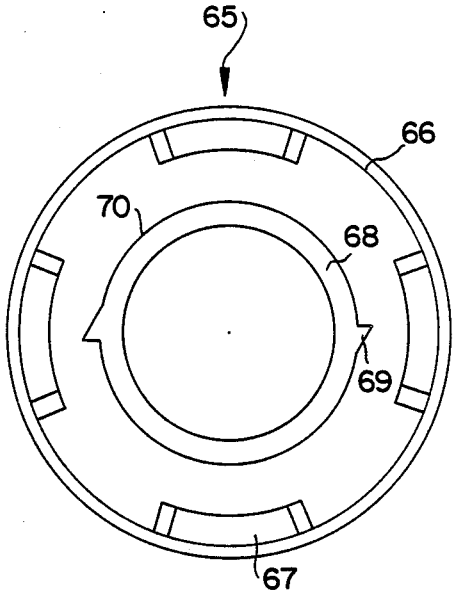
FIG. 23 is a top view of the inner cap.

FIG. 14 shows a container 50 and cap 51. The cap 51 has a vertical grove 52 cut into the skirt 56. The container 50 has a grove 53 cut in the shoulder 57.

Figure 15:
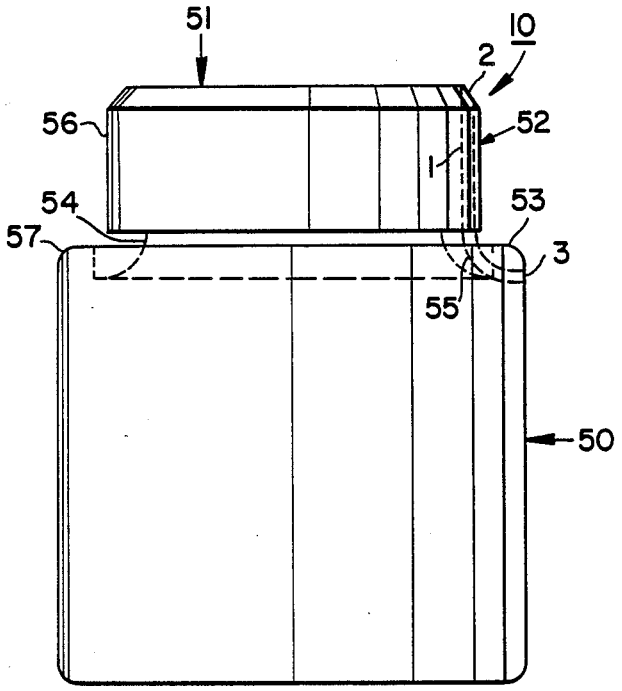
FIG. 15 is a left side view of FIG. 14 with the invention inserted.

FIG. 15 is a left side view of FIG. 14 with the device 10 inserted in the groves 52 and 53.

Figure 16:
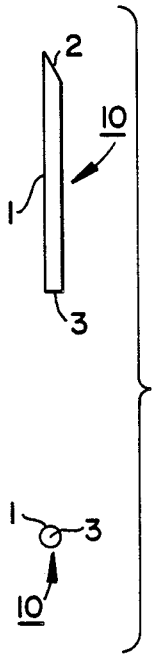
FIG. 16 is a left side view of the invention and, a bottom view of the invention.

FIG. 16 shows the device 10 from the left side view above and the end view below. The cap is put on the bottle so that the groves 52 and 53 are in alignment. The device 10, which in this case, is a short length of fiber optic material with ends finished smooth as shown in FIG. 16, is inserted and bonded by a suitable adhesive so that the light collecting end 2 is at the top of the cap 51. The invention extends down through the grove 52 in the skirt 56, through the gap between the lower edge of the skirt 56 and into the grove 53 in the shoulder 57 with the fiber end 3 facing outwards. Light enters the surface 2, travels through the guide 1, around the bend in the guide 55 and out the exit 3, giving a bright appearance to the dot. To open the container 50, a torque is applied to the cap 51. This results in a tearing apart of the light guide 1 near the point 55 which is bent and under stress, this is the section for interruption. Upon breaking, the broken ends tend to flex away from one another further increasing the difficulty of repair.

FIG. 17 is an exploded view of a combination child proof and tamper evident closure 60 which does not require bonding to the container. The closure 60 comprises an outer cap 61, the device 10, and an inner cap 65. The device 10 is mounted in the outer cap 60 so that the light collecting surface 2 is placed facing upward in the hole 62 in the top of the outer cap 61. The light exit or indicator is situated in the hole 63 in the skirt 76 of the outer cap 61 and faces forward. The inner cap 65 comprises a lower cup shaped portion with internal treads, a rim 66 for interlocking to outer cap 61, complimentary lugs 67 for engagement to lugs 72 of the outer cap 61 for the child proof feature, a cylindrical upper portion 70 with ratchet teeth 69, and an upper surface 68 for interruption of the device 10.

FIG. 18 shows a front view of the device 10 configured to fit the cap 60 of FIG. 17 comprising a light guide 1, a surface 2 for collecting light, and an indicator surface 3.

Figure 20:
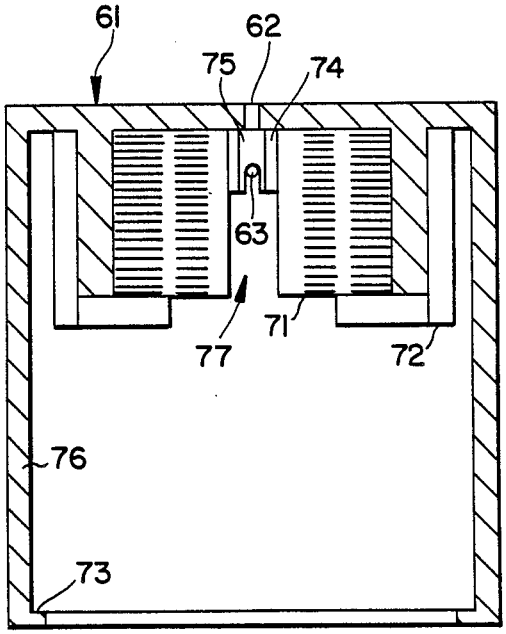
FIG. 20 is a sectional view of the top cap 61 of FIG. 17 along the line 90—90.

FIG. 19 shows a left side view of the device 10 shown in FIG. 18. FIG. 20 is a vertical section of the outer cap 61 taken along 90—90 as in FIG. 17. We see in FIG. 20 the hole 62 in the top of the outer cap 61 for the end 2 of the device 10. The hole 63 in the skirt 76 can also be seen.

Figure 21:
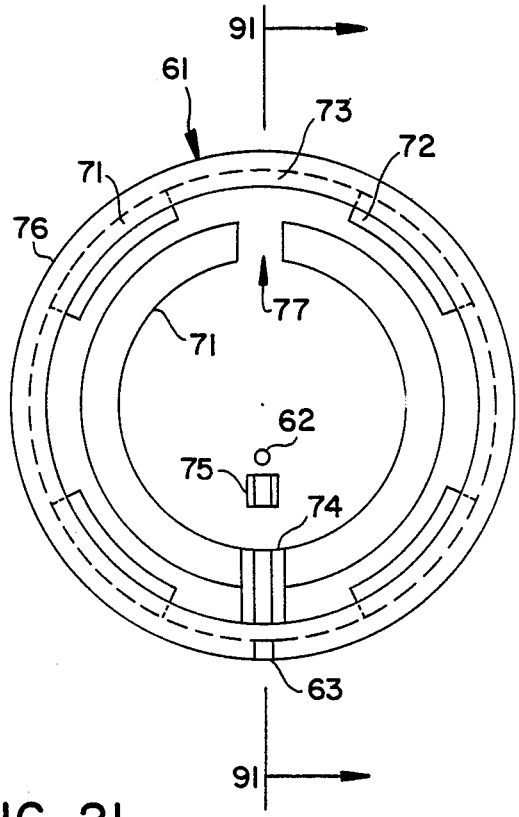
FIG. 21 is a plain bottom view of the top cap as in FIG. 20.

Now, referring to FIG. 21, the device 10 is bonded down into the support 74 and 75 such that the end 2 enters the hole 62 and the end 3 enters the hole 63. The light guide 1 is now bridged across the gap between the supports 74 and 75, this is the section for interruption. To assemble the closure 60, the inner cap 65 is pushed into the outer cap 61 such that the upper cylindrical section 70 of the inner cap 65 enters the inner cylinder 71 of the outer cap 61 with the ratchet teeth 69 of said inner cap 65 entering the slots 77 in said cylinder of said outer cap 61.

Figure 22:
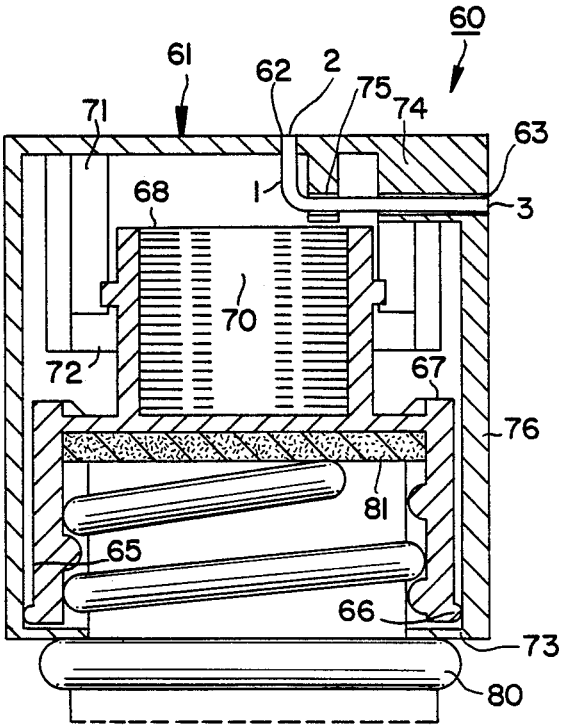
FIG. 22 is a cross section along 91—91 of FIG. 21 of the top cap 61 combined with the inner cap 65 and the tamper evident device 10.
Figure 24:
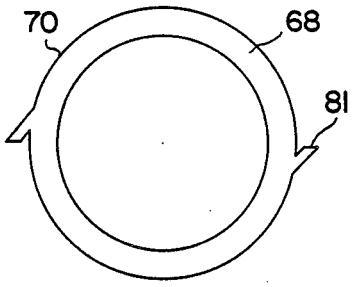
FIG. 24 is a top view of the ratchet teeth of the inner cap showing another version of the teeth.

Referring to FIG. 22, the closure 60 can be screwed onto the bottle 80. In the closure on direction, the ratchet teeth 69 lock in the slots 77 of the outer cap 61 and the closure 60 can be screwed on the neck 80 of the container until the seal 81 is fully seated. The closure 60 is made from a somewhat flexible material, and thus the teeth will ratchet escape in the closure off direction due to a flexing inward of the cylinder 70 and a flexing outward of the cylinder 71. For stiffer outer cap 61 materials, the ratchet teeth can be designed to be more flexible as shown in FIG. 24. Also, more pairs of slots and teeth can be employed.

Figure 25:
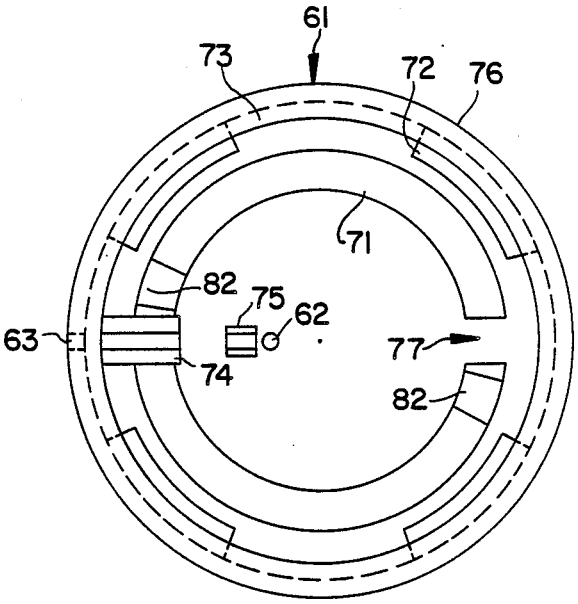
FIG. 25 is a bottom view of the outer cap showing a version with notches for the ratchet teeth to prevent accidental breaking of the light guide.
Figure 26:
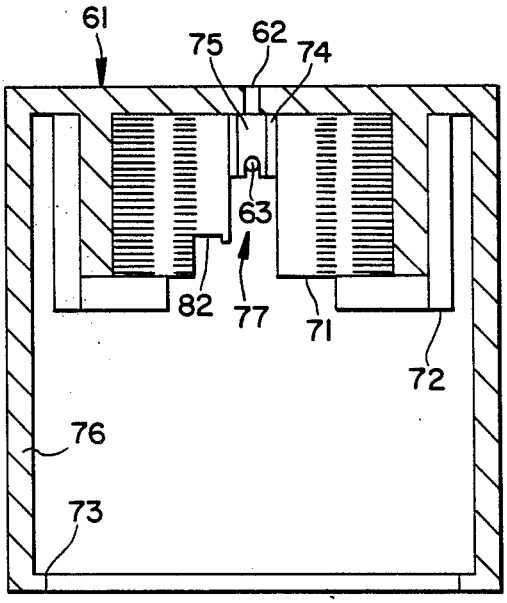
FIG. 26 is a cross sectional view as in FIG. 20 but with notches for the ratchet teeth.

Once the cap 60 is tightened on, a twisting effort in the closure off direction will result in the teeth 60 ratchet escaping and thus, the outer cap 61 will simply turn about the inner cap 65 and the closure will not come off. To remove the closure 60, the outer cap 61 must be pushed down to engage the complimentary lugs 67 of the inner cap 65 with the lugs 72 of the outer cap 61. As said cap 61 is depressed, the interrupting surface 68 of the inner cap 65 tears a section from the light guide 1 between the supports 75 and 74. The light exit 3 now goes dark, indicating tampering. Another version that prevents the outer cap from being accidentally pushed down during the initial capping of the bottle is shown in FIG. 25 and FIG. 26.

The inner cylinder 71 of the outer cap 61 has a pair of notches 82 cut from the surfaces. When the closure is assembled, the inner cap 65 is inserted such that the ratchet teeth 69 or the version 81 of FIG. 24 of said cap rest in the notches 82. Now, this version of the closure 60 cannot be accidentally pushed down into the tampered state before or during the cap on tightening down. Once tightened, the outer cap 61 must be lifted, backed off, and then pushed down to break the light guide 1, and engage the lugs. Now, with downward pressure and a twisting effort in the cap off directin, the closure can be removed; the indicator 3 now being dark. The angled ends of the lugs 67 of the inner cap 65 make necessary a constant downward pressure during removal, thus providing the child proof feature.

Figure 27:
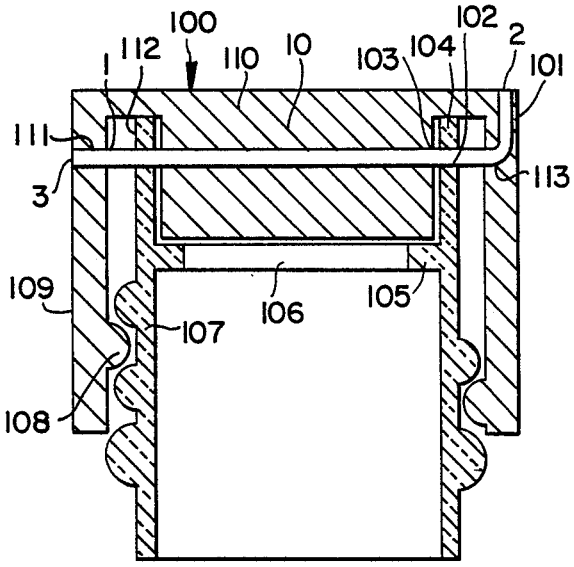
FIG. 27 is a cross sectional view of the invention inserted transversely through both cap and container neck.

FIG. 27 is another example of how the device 10 can be used. A bottle closure 100 comprising a plug 110, a skirt 109 with inner threads 108, a vertical grove 101 in said skirt 109, a hole 113 intersecting with said vertical grove 101, a hole 103 through said plug 110 and a hole 111 at the opposite side of said closure 100 from said hole 103. Said holes 103, 113, and 111 being axially aligned and of a diameter to accomodate the device 10. The closure 100 is screwed on the bottle neck 104 until the plug 110 is seated on the seal 106 over the inner rim 105. The series of holes 103, 113, and 111 are aligned with the holes 102, and 112 in the bottle neck 104. The device 10 is then inserted with a suitable permanent adhesive such that the vertical section of the device 10 is upright in the vertical grove 101 of the skirt 109. The light guide 1 passes through the holes 113 in the skirt 109, 102 in the neck 104, 103 in the plug 110, 112 in the neck 104, and 111 in the skirt 109. Light will now be collected by the surface 2 of the device 10, passed through the light guide 1 and out the exit 3, indicating a safe bottle.

Now, upon opening, the light guide 1 is broken in four places, two breaks between the skirt 109 and the bottle neck 104 and two breaks between the inside of the bottle neck 104 and the plug 110; the indicator 3 goes dark, indicating that tampering has taken place.

In another version of this design, the invention can be placed so that the surface 2 is positioned above the plug 110 and thus only two breaks would take place.

Yet another version of this design can be made by preassembling the closure 100 with a neck section which then is attached to the container after filling. FIG. 29 shows another way to utilize the device 10, this method uses two caps. The first cap screws onto the bottle 130 and can be of any type, with the addition of a top section with holes through which the light guide 1 can be threaded; lugs, blocks, or just an extension of the cap itself will do, in this design, a cylindrical extension 126 with holes 128 and 129 is employed. The overcap 120 comprises a cup shaped main body 124 and an inner plug 121 concentrically mounted. The skirt of the overcap has two holes 122 and 123 axially aligned and spaced 180° apart. The plug 121 has a through hole 131 axially aligned with said holes in the skirt. The plug 121 is of a diameter and depth so as to fit within the cylindrical extension 126 on the top of the first cap 125 with the hole in the plug axially aligned with the holes 128 and 129 of said cylindrical extension 126. The plug can be a set of lugs with holes, or any other equivalent means. After the first cap 125 is tightened to the bottle 130, the overcap 120 is pushed down over the neck 127 so that the holes in said overcap 122 and 123 axially align with the holes 128 and 129 of the cylindrical extension 126 of the first cap 125.

The device 10 is then inserted with a coating of a suitable adhesive, so that the face 2 is up. The face 3 will now glow under average lighting condition, thus indicating that the container is safe.

Upon opening the container, the twisting effort applied to the overcap 120 will cause the light guide 1 to break in four places; providing that the torque required to break the light guide is less than that to break free the inner cap, if not, a seal or the like can be used to bond the inner cap to the bottle.

Upon breaking, the indicator 3 will go to a dark condition. FIG. 30 is a fragmentary cross sectional view of the upper right hand corner of the closure 60 as shown in FIG. 22, modified to provide a color change mode. The light impinges from above and enters the surfaces 2 of the light guides 140 and 141, both of which feed the larger guide 142. Wherein the two colors A and B respectively combine to yield a resultant color C at the light output 3. An example of this would be A=Yellow, B=Blue, and then C would be Green. This follows standard rules of color mixing.

Now as in FIG. 22, the section for interruption of one of the light guides is bridged between the support 74 and 75, the outer cap 61 is pushed down to open the container and the surface 68 of the upper cylinder of the inner cap 65, breaks the yellow light guide 140 causing the output to change from green in the untampered state to blue in the tampered state. A wide range of color changes can be chosen by utilizing a chromaticity diagram for color mixing.

FIG. 31 is another modification of the upper right hand corner of FIG. 22 and shows another version of the displacement type. The light enters the surface 2, travels through the upper guide 1, through the gap 5, formed by the supports 74 and 75, through the lower guide 6, and out the exit 3.

Upon depression of the outer cap 61, the surface 68 of the upper cylinder 70 of the inner cap 65 displaces by bending the lower guide 6 away from the upper guide 1. In this version, the surface 68 is somewhat narrower with respect to said gap between 74 and 75 and contacts the lower guide 6 near the gap 5.

FIG. 32 is another version utilizing the closure 60 of FIG. 22 with a modification of the upper right hand corner. This is a blocking version. Light enters the tamper evident device through surface 2, travels through the upper guide 1, across the gap 5, through the lower guide 6, and out the exit 3. The blocking element 145 is a snug fit in the space between the supports 74 and 75. Upon depressing the outer cap 61, the surface 68 pushes the blocking element up, entering in the gap 5, thus blocking the light and causing a change of the indicator output 3.

FIG. 33 is another example utilizing the closure 60 of FIG. 22 with a modification of the upper right hand corner. This is a tamer evident design which produces a color change after tampering. The design comprises two light guides 150 and 151 of different colors A and B and a switching arrangement that interrupts one light guide and connects the other upon tampering. Light enters the surfaces 2 of the light guides 150 and 151. In the untampered state, the light travels through the light guide 150, across the gap 152, through the guide 153, and out the exit 3, providing an indication of color A. When the outer cap 61 is depressed, the surface 68 of the inner cap 65 pushes the block 155 up, interrupting the light from 150 and repositioning the guide 153 to receive the light from 151. The block 155 is a tight fit in the space between the supports 74 and 75 and stays in the new position. Thus the light output changes from color A in an untampered state to color B after tampering.

While the foregoing embodiments have illustrated the principals of the invention, it is clear that a large number of different versions are possible. For example, many designs will readily occur when the closure material is made transparent. The light entrance and exit need not be disposed through the outer cap, and the cap itself can serve as a lens. A clear bottle can be employed so that viewing of the indicator occur through the wall. Thus numerous changes and modifications can be made without departing from this invention in its broader aspects and therefor, the aim of the claims is to cover all such variations as fall within the true spirit and scope of the invention.

What is claimed is:

1. A packaging system for packaging a product and indicating whether the packaging system has been opened so as to provide evidence of tampering, said system comprising, in combination:

a container;

a cap, including a top and a skirt, for closing the container;

light guide means for providing said evidence of tampering and including a light collecting surface for collecting ambient light, a light emitting surface for emitting at least a portion of the light transmitted through the guide means, and an intermediate section between said light collecting and emitting surfaces and constructed so as to be in a first condition when said cap is initially secured to said container and in a second condition when said cap is initially removed from said container, and wherein said light guide means is secured within said cap so that the light collecting surface collects light at the top of said cap, and the light emitting surface emits light from the skirt of said cap when said intermediate section is in at least one of said conditions; and means for permanently modifying said intermediate section so as to change the condition of said intermiate section from said first condition to said second condition when said cap is initially removed from said container so as to alter the light emitted from said light emitting surface.

2. The system according to claim 1, wherein said intermediate section includes a breakpoint of sufficient weakness so that said breakpoint is severed by said means for permanently modifying said intermediate section when said cap is initially removed from said container.

3. The system according to claim 1, wherein said intermediate section includes an optical coupling including at least two members, wherein said two members are optically coupled in one of said conditions, and one of said members is displaced from the other of said members in the other of said conditions.

4. The system according to claim 3, wherein said intermediate section includes a gap, and said means for permanently modifying said intermediate section includes a blocking element positioned so as to enter said gap when said cap is initially removed from said container.

5. The system according to claim 1, wherein light is emitted from said light emitting surface of said light guide means for both of said first and second conditions, with the color of the light being a first color when said intermediate section is in said first condition and a second and different color when said intermediate section is in said second condition.

6. The system according to claim 5, wherein (a) said light guide means includes at least three light guide elements, wherein one of said elements is coupled to (i) a second one of said light guide elements in the first condition so as to emit light from said light emitting surface of a first color, and (ii) the third one of said light guide elements in the second condition so as to emit light from the light emitting surface of a second color; and (b) said means for permanently modifying said intermediate section includes means for moving at least a portion of said one light guide element from a position of being coupled to said second light guide element to a position of being coupled to the third light guide element when said cap is initially removed from said container.

7. The system according to claim 5, wherein (a) said light guide means includes at least three light guide elements, wherein one of said elements is coupled to (i) the second and third of said light guide elements in the first condition so as to emit light from said light emitting surface of a first color, and (ii) only the second of said light guide elements in the second condition so as to emit light from the light emitting surface of a second color; and (b) said means for permanently modifying said intermediate section includes means for interrupting light transmitted between said first and third light guide elements when said cap is initially removed from said container.

8. The system according to claim 1, wherein said means for permanently modifying said intermediate section includes means for interrupting at least a portion of light transmitted through said light guide means when said cap is intially removed from said container.

9. The system according to claim 1, further including a second inner cap disposed within first mentioned cap so as to form a cap closure such that said first cap is movable between a raised and lowered position with respect to said second cap, and ratchet locking engagement means, cooperative with said first and second caps, for coupling said first and second caps when said first and second caps are turned in a thread on direction, and for coupling said first and second caps only when said first cap is force downward toward said second cap and said first cap is turned in a thread off direction.

10. The system according to claim 9, wherein said ratchet locking engagement means includes ratchet teeth and means for defining at least one notch for engagement of said ratchet teeth in one position of said first cap relative to said second cap so as to prevent the downward movement of said first cap relative to said second cap.

11. The system according to claim 1, further including a second inner cap disposed within said first mentioned cap so as to form a cap closure, wherein said first and second caps each includes at least one hole, wherein said light guide means is secured in said holes so that said intermediate section is broken when said cap closure is removed from said container.

12. A packaging system for packaging a product and indicating whether the packaging system has been opened so as to provide evidence of tampering, said system comprising, in combination:

a container having a top and bottom as determined by the container when in an upright position;

a cap for closing the top of the container;

light guide means including a light collecting surface for collecting ambient light, a light emitting surface for emitting at least a portion of the ambient light transmitted through the guide means, and an intermediate section between the light collecting surface and light emitting surface, wherein said light guide means is secured within said cap when the cap intially closes the container so that when the container is in its upright position the light collecting surface faces generally in a vertical direction so as to collect ambient light generally from above the container and cap and the light emitting surface faces generally in a horizontal direction so as to emit light generally in the horizontal direction; and means for permanently modifying said interrupt section when said cap is initially removed from said container so as to modify the light emitted from said light emitting surface.

13. The system according to claim 12, wherein said container includes at least one hole, said cap includes at least one hole, and said light guide means is secured to said container and cap so that said light collecting surface faces through said hole of said cap and said light emitting surface faces through said hole of said container.

* * * * *